US009322203B2

(12) United States Patent
Kleiman

(10) Patent No.: US 9,322,203 B2
(45) Date of Patent: Apr. 26, 2016

(54) MINI SLAT FOLDING DOOR

(71) Applicant: Hoggan Internacional SA

(72) Inventor: Ronny Kleiman, Boca Raton, FL (US)

(73) Assignee: Hoggan Internacional SA, San Jose (CR)

( * ) Notice: Subject to any disclaimer, the term of this patent is extended or adjusted under 35 U.S.C. 154(b) by 0 days.

(21) Appl. No.: 14/487,882

(22) Filed: Sep. 16, 2014

(65) Prior Publication Data

US 2015/0075730 A1 Mar. 19, 2015

Related U.S. Application Data

(60) Provisional application No. 61/878,114, filed on Sep. 16, 2013.

(51) Int. Cl.

| | |
|---|---|
| ***E06B 3/48*** | (2006.01) |
| ***E05D 15/26*** | (2006.01) |
| ***E06B 3/70*** | (2006.01) |
| ***E05D 15/06*** | (2006.01) |

(52) U.S. Cl.

CPC ..... *E05D 15/26* (2013.01); *E05D 15/063* (2013.01); *E06B 3/481* (2013.01); *E06B 3/7003* (2013.01); *E05Y 2201/64* (2013.01); *E05Y 2900/132* (2013.01)

(58) Field of Classification Search

CPC ..... E06B 3/481

USPC ..... 160/199, 206, 213, 230, 231.1, 231.2, 160/84.01, 84.06, 290.1, DIG. 16

See application file for complete search history.

(56) References Cited

U.S. PATENT DOCUMENTS

| | | | | | |
|---|---|---|---|---|---|
| 2,244,300 | A * | 6/1941 | Kwon | A47H 23/14 | 160/196.1 |
| 2,713,899 | A * | 7/1955 | Holloway | E06B 3/481 | 16/105 |
| 2,724,434 | A * | 11/1955 | Smith | A47H 23/14 | 160/231.1 |
| 2,770,298 | A * | 11/1956 | Hiatt | E05D 15/26 | 16/104 |
| 2,798,246 | A * | 7/1957 | Holloway | E05D 15/26 | 16/95 R |
| 2,937,398 | A * | 5/1960 | Latham | E05D 15/26 | 16/104 |
| 3,073,382 | A * | 1/1963 | Zimmerman | E06B 3/481 | 156/257 |
| 3,359,594 | A | 12/1967 | Pastoor | | |
| 3,405,756 | A | 10/1968 | Harris | | |
| 3,419,063 | A | 12/1968 | Mock et al. | | |
| 3,799,237 | A * | 3/1974 | Proserpi | E06B 3/481 | 160/199 |

(Continued)

*Primary Examiner* — David Purol

(74) *Attorney, Agent, or Firm* — Robert C. Kain, Jr.

(57) ABSTRACT

The invention provides a flexible folding door adopted to be attached to an existing door jamb comprising a plurality of mini slats. A subplurality of mini slats are bounded on a forward end by a clip to establish a non-folding bound panel segment of the door. A second subplurality of mini slats establish the folding panel seam segments of the door. There is a dual caster assembly and a plurality of single caster assemblies attached to the top of the folding door. The caster assembly consists of at least two low friction wheels mounted on a U-shaped frame having depending legs, each depending leg having a low friction sleeve, the distal portion of each leg is attached perpendicularly to a ring. A stem is adapted to be seated through the ring and through an aperture in the clip and the top of the stem has a cap that overhangs the ring. A retaining pin secures the stem within the ring and thereby attaches the assembly to the clip and the folding door. The wheels of the caster assemblies are seated in the hanging channel track allowing the folding door to be slid open and closed.

21 Claims, 14 Drawing Sheets

(56) References Cited

U.S. PATENT DOCUMENTS

| | | | | | |
|---|---|---|---|---|---|
| D239,435 | S | | 4/1976 | Galleti | |
| 3,972,365 | A | * | 8/1976 | Dixon | E06B 3/481 160/183 |
| 4,083,395 | A | * | 4/1978 | Romano | E06B 3/481 160/199 |
| D259,330 | S | | 5/1981 | Stine | |
| 4,276,919 | A | * | 7/1981 | Walters | A47K 3/362 160/199 |
| 4,386,645 | A | * | 6/1983 | Dever | E05D 1/04 16/355 |
| D278,794 | S | | 5/1985 | Vater | |
| D345,018 | S | | 3/1994 | Maas | |
| 5,373,887 | A | | 12/1994 | Glover | |
| D406,355 | S | | 3/1999 | Kinsey | |
| 6,296,038 | B1 | * | 10/2001 | Chen | E06B 3/481 160/118 |
| D489,964 | S | | 5/2004 | Leelaprachacul | |
| D511,895 | S | | 11/2005 | Vish et al. | |
| D557,900 | S | | 12/2007 | Sijmons | |
| D593,847 | S | | 6/2009 | Graffunder et al. | |
| D639,640 | S | | 6/2011 | Koehn | |

* cited by examiner

MINI SLAT FOLDING DOOR

STATEMENT OF PRIORITY

This application is a nonprovisional application under 35 U.S.C. §111(a) and 37 CFR §1.53(b) claiming priority to provisional application No. 61/878,114 filed on Sep. 16, 2013, the contents of which is incorporated herein by reference thereto.

FIELD OF INVENTION

The invention relates generally to flexible folding door with mini slats that is attachable to a door jamb.

BACKGROUND OF THE INVENTION

Folding doors increase the usable area of room that is otherwise taken up by a hinged door that swings open. Folding doors simply fold back accordion style, with the use of many vertical folds, against the door jamb allowing the user to use all the available space in the room, without having to save a clear path for a door to swing open or close. Folding doors are typically an economical and space-saving solution where doors are needed when a standard door would impede upon the function of the room. Folding doors are commonly used as interior doors to separate rooms or for use as a closet door.

Folding doors are hung from a track attached to the header of the door jamb. A folding door needs to be sturdy and structurally sound to withstand forces from all directions when the door is being pulled open or closed along a door header. Accordingly, folding doors are often complex and not easy to install. Moreover, if the door and jamb attachment mechanisms are not sturdy, frequent use of the door can damage the attachment mechanisms and impede normal function of the door.

Therefore, there is a need in the art for a sturdy and structurally sound folding door that is easy to install on an existing door jamb. There is also a need for a folding door that contains durable and flexible attachment mechanisms that can withstand forces from all directions when the door is being pulled open or closed along the header mechanism.

There is a further need for a folding door that is made of material that is flexible, renewable and durable.

SUMMARY OF THE INVENTION

The present invention is a folding door adapted to be attached to a door jamb having a forward door jamb, a header, and a rear door jamb. There are a plurality of mini slats adapted to be hung vertically from the door header via a hanging channel track attachable to the header. Each mini slat is horizontally coupled together such that the plurality of mini slats form a flexible folding door panel. The folding door panel is adapted to substantially span and enclose a space between the forward and rear door jamb. The flexible folding door panel has a forward end near the forward door jamb and a rearward end near the rear door jamb. The folding door panel defining, in series, bounded vertical plane door segments interposed between folding seam door segments. Each bounded vertical plane segment has a first subplurality of mini slats maintained in a substantially single vertical plane by a top binder. Each folding seam segment having a second subplurality of mini slats which establish the folding panel seam segments of the folding door. The seam segments are intermediate to the plane segments. The forward end of the folding door panel has a forward edge segment adapted to be adjacent said forward door jamb. The forward edge segment has a door closure element.

The forward jamb edge piece is adapted to be fixedly attached to the forward door jamb. The forward jamb edge piece has a complementary closure element adapted to cooperate with the closure element on said forward edge segment permitting the folding door panel to open and close on the forward door jamb. The folding door panel has a rearward edge piece adapted to be attached to the rear door jamb. A plurality of caster assemblies are movably disposed in the hanging channel track, a respective caster assembly attached to a corresponding top binder. Each caster assembly includes: (1) one or more low friction wheels adapted to move in the hanging channel track and (2) a depending stem extending downward below the wheels. The depending stem forms a low friction interface with the adjacent depending track edge. The depending stem has a terminal lower end stop. Each top binder defines an aperture at its upper surface. The depending caster stem extends through the top binder aperture such that the lower stop is below the upper surface of the top binder to capture the stem and the caster assembly atop the top binder. The stem permits three dimensional movement of the vertical plane segments with respect to said hanging channel track.

In the preferred embodiment, the mini slats of the folding door are composed of bamboo. In alternate embodiments, any durable, renewable material may be used to compose the mini slats. In the preferred embodiment, the folding door will come in a package almost completely built, so that the end user will simply install the forward jamb edge piece to the forward door jamb, the hanging channel track to the header, the rear edge piece to the rear door jamb, and hang the complete folding door panel with casters.

Although the invention is illustrated and described herein in reference to a specific embodiment, it is nevertheless not intended to be limited to only the details shown, since various modifications and structural changes may be made therein without departing from the spirit of the invention and within the scope and range of equivalents of the claims. The construction of the invention, however, together with additional objects, features, and advantages thereof will be best understood and appreciated from the following detailed description of the embodiments thereof, selected for purposes of illustration and shown in the accompanying drawings.

DETAILED DESCRIPTION

Embodiments of the invention are illustrated in the accompanying drawings. The present invention can be best understood by referring to the enclosed drawings and the following explanation.

Figure 1:
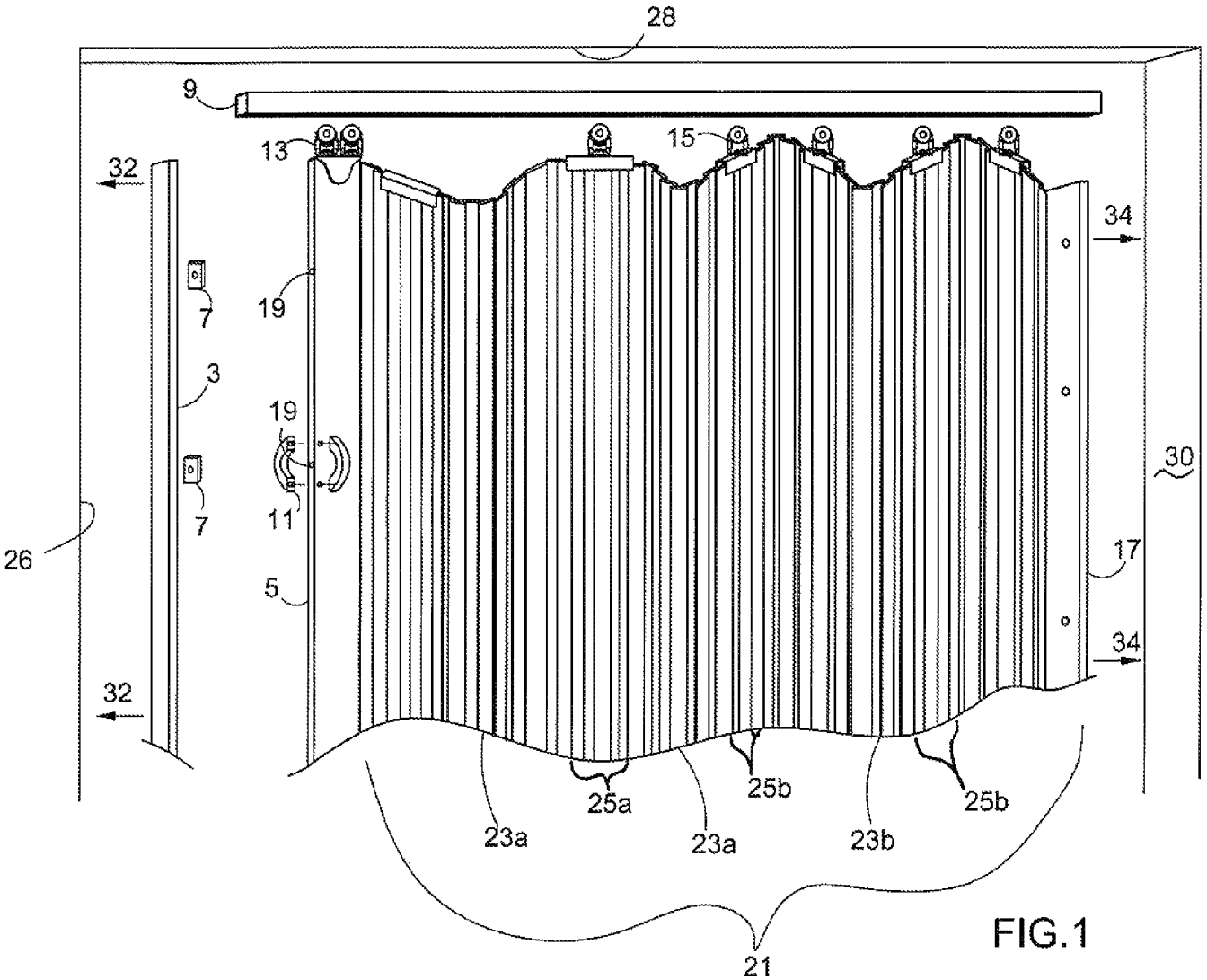
FIG. 1 is an exploded view of the folding door showing accordion folded segments in accordance with the principles of the present invention.

FIG. 1 is an exploded view of the folding door showing accordion folded segments in accordance with the principles of the present invention. The folding door system 1 is attachable to the jamb of the doorway, namely, the forward door jamb 26, the header 28, and the rear door jamb 30. The forward jamb edge piece 3 is permanently attached to the forward door jamb 26 with screws as shown by arrows 32.

The folding door, in one embodiment, is a do-it-yourself kit which the home owner or occupant can easily install. The kit includes door 1, forward jamb piece 3, track 9 and certain handle pieces and mounting fixtures (screws, nails, etc.).

The hanging channel track 9 is attached to the header 28 of the doorway. The hanging channel track 9 is the track from which the folding door panel 21 will be vertically hung. The rear edge door piece 17 of folding door 1 is permanently attached to the rear door jamb 30 with screws or other similar attachment means as shown by arrows 34. The rear edge door piece 17 is also attached to the rearward end of the folding door panel 21. Accordingly, once the rear edge door piece 17 is attached to the rear door jamb 30, that attachment will form the portion of the folding door panel 21 that will remain somewhat permanently secured to the rear door jamb 30. The fore end leading edge door piece 5 is the leading edge of the folding door panel 21. A dual caster assembly 13 is attached to the top of the fore end leading edge door piece 5. A door handle 11 is attached to the fore end leading edge door piece 5.

The terms "forward" and "rear" refer to portions of the door jamb. The "forward" region is where the folding door normally opens, permitting entry and exist into the room. "Rear" or "rearwards" refers to the somewhat permanently a fixed door region at the opposite door jamb.

When the folding door panel 21 is shut, closing the door jamb opening, the forward jamb edge piece 3 receives the fore end leading edge door piece 5 and the folding door panel 21 is removably secured in place. The forward jamb edge piece 3 has a complementary closure element 7 adapted to cooperate with the closure element 19 on the forward edge segment permitting the folding door panel 21 to open and close on the forward door jamb 26. The complementary closure system shown in the preferred embodiment is a magnetic system; however, any appropriate closure system may be used. Alternate complementary closure systems are a hook and eye system, a latch system, a loop and post system, or any other known closure system. As shown, magnetic plates 7 are seated within the forward jamb piece 3. Magnetic buttons 19 are fixed in the fore end leading edge door piece 5. When the folding door panel 21 is moved to a closed position wherein persons and items cannot pass through the door opening, the magnetic plates 7 attract the magnetic buttons 19 and the folding door panel 21 is secured in the closed position.

The folding door panel 21 is composed of a plurality of segments that are primarily divided between two segment groups: (1) a fixed or bound panel segments 25*a*, 25*b*, 25*c* and (2) a folding panel seam segments 23*a*, 23*b*. The segments are serially interposed such that each panel is bounded or intermediate a seam segment. These segments create the accordion style fold of the door. Bound segments fold next to each other such that 25*a* is next to 25*b*; 25*b* is next to 25*c*; when the door is in an open mode operational position.

The fixed or bound panel segments include a forward bound panel segment 25*a*, a plurality of mid bound panel segments 25*b* and rear bound panel segments 25*c*.

A single caster assembly 15 is attached to the vertical center line of the mid bound panel segments 25*b*. The folding panel seam segments include a forward folding panel seam segment 25*a* and a number of mid folding panel seam segments 25*b*.

Figure 2:
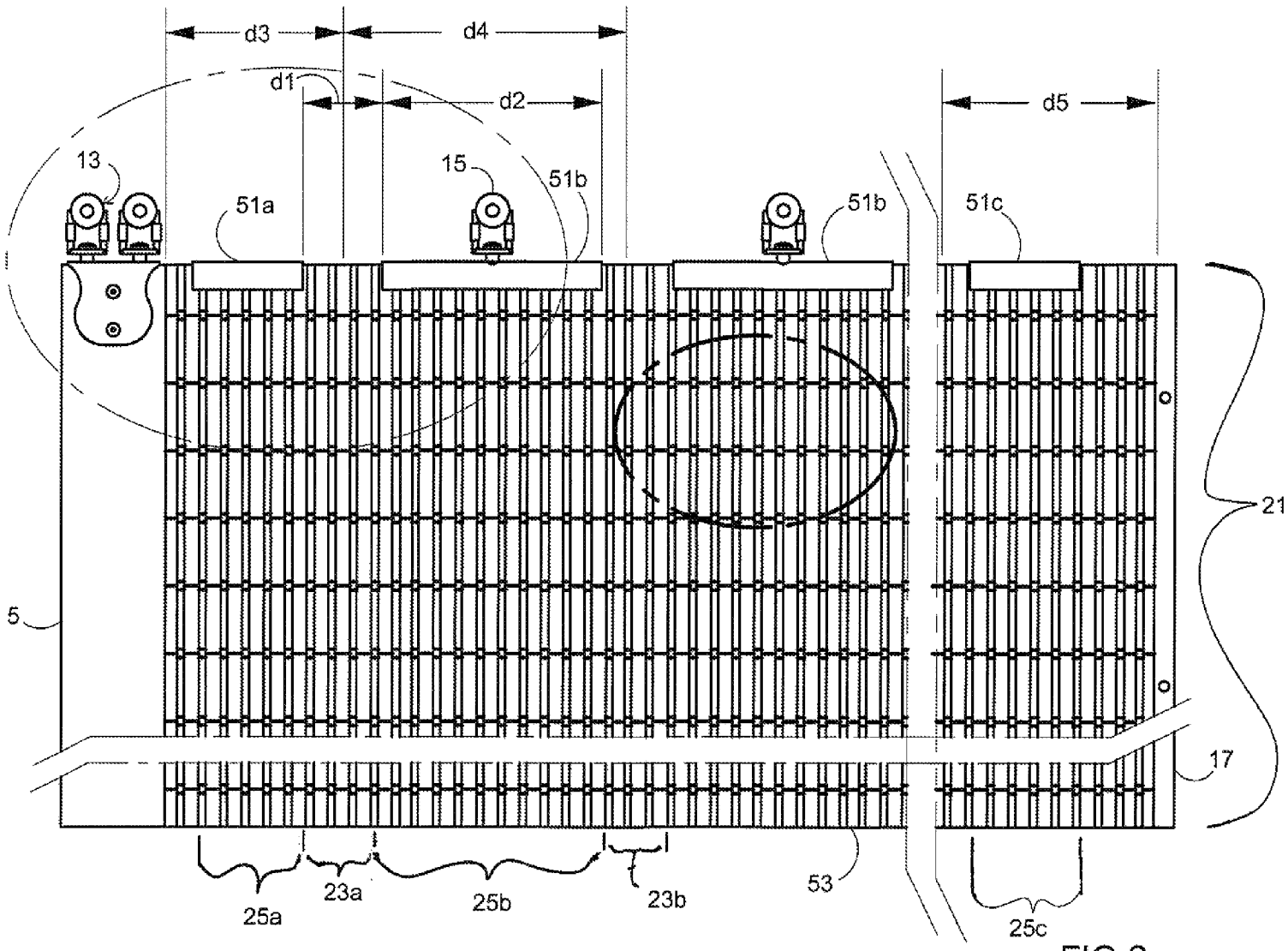
FIG. 2 is a front view of the folding door panel in an open state.

FIG. 2 is a front view of the folding door panel 21 in an open operational state. The mini slats 53 that comprise the door panel 21 are vertically positioned in the header track channel and the slats overlap to form a highly flexible door panel 21. The mini slats 53 of the preferred embodiment are approximately 2 to 5 millimeters wide, but the slats could be larger as long as they work within the door as designed. One key feature of the many described herein is that a plurality of slats form (a) a bound-together panel segment and (b) another plurality form folding seam segments. The mini slats 53 can be made from a variety of material, such as bamboo, wood, plastic, or any other suitable materials. In the preferred embodiment, the material used is bamboo as it is a renewable resource and is both strong and flexible. The folding door panel 21 is designed to be cut to fit the height of the doorway and the width of the doorway. The bottom section of folding door panel 21 can be cut or sawed off horizontally across the slats to fit the doorway. The wide span of the folding door can be cut by cutting the horizontal attachment threads.

The fixed or bound segments 25*a*, 25*b*, 25*c* and a folding seam segments 23*a*, 23*b* are shown in greater detail in FIG. 2. Forward bound panel segment 25*a* is shown adjacent to the fore end leading edge door piece 5. Forward bound panel segment 25*a* is held in a singular segment fixed plane by forward top binder 51*a*. See FIG. 12. The top binder 51 may be a clip, bar, cast elements, metal or plastic bands or other suitable devices that would serve to bind the mini slats 53 within a fixed plane. Forward top binder 51*a* is not connected to a caster assembly, as the forward bound panel segment 25*a* falls within the same plane as the fore end leading edge door piece 5 which contains the dual caster assembly 13. A dual caster assembly 13 is attached to the top edge region of the end piece 5. There is no caster assembly on top binder 51*a*. Mid bound panel segments 25*b* are located in the middle sectional portion of the folding door panel 21 and are each respectively held in a fixed segmental plane by mid top binder 51*b*. There will be as many mid bound panel segments 25*b* as required to form the necessary width (or length across the doorway) of the folding door panel 21. Rear bound panel segment 25*c* is shown adjacent to the rear edge door piece 17.

Rear bound panel segment 25*c* is held in a fixed vertical segment plane by rear clip 51*c*. Rear top binder 51*c* is not connected to a caster assembly. Forward folding panel seam segment 23*a* is located adjacent the forward bound panel segment 25*a* and the slats 53 of the forward folding panel seam segment 23*a* are subject to folding action of about 0° to about 180°. Mid folding panel seam segments 23*b* are located adjacent and bound, left to right, the mid bound panel segments 25*b* and are subject to folding action of about 0° to about 180°. Accordingly, when the folding door panel 21 is opened, the folding panel seam segments 23*a*, 23*b* fold to allow the bound or fixed segments 25*a*, 25*b*, 25*c* to collapse against each other and stack against the rear door jamb 30.

In the preferred embodiment, the folding door system 1 is a center mount door where each mid bound panel segment 25*b* is hung from the top center of that segment by a single caster assembly 15. This creates a balanced folding door panel 21 that is suspended from the hanging track channel 9. As shown in FIG. 2, there are designated lengths of certain portions of the folding door panel 21. The measurements of the folding door panel 21 are critical to ensure the door has equal folds when in the closed position. Measurement d1 is the length of a folding panel seam segment 23*a*, 23*b*. Measurement d2 is the length of a mid bound panel segment 25*b*. Measurement d3 is the length of the folding door panel 21 that is composed of: (1) the forward bound panel segment 25*a*, (2) half of the forward folding panel seam segment 23*a*, and (3) a number of mini slats that connect the fore end leading edge door piece 5 with the forward bound panel segment 25*a*. Multiple mini slats which respectively form (a) each bond segment and (b) left and right adjacent folding segments, establish the small compact size of the fully open door. Measurement d4 is the length of the folding door panel 21 that is composed of: (1) half (1/2) of a folding panel seam segment 23*a*, (2) mid bound panel segment 25*b*, and (3) half (1/2) of another folding panel seam segment 23*b*. Measurement d4 is the length (left to right) of the folding door panel 21 that will remain in a fixed plane and stack up against each other bound segment at the door jamb when the door is fully opened. Measurement d5 is the length of the folding door panel 21 that is composed of: (1) half (1/2) of a mid folding panel seam segment 23*b*, (2) the rear bound panel segment 25*c*, and (3) a number of mini slats that connect the rear edge door piece 17 with the rear bound panel segment 25*c*.

Figure 3A:
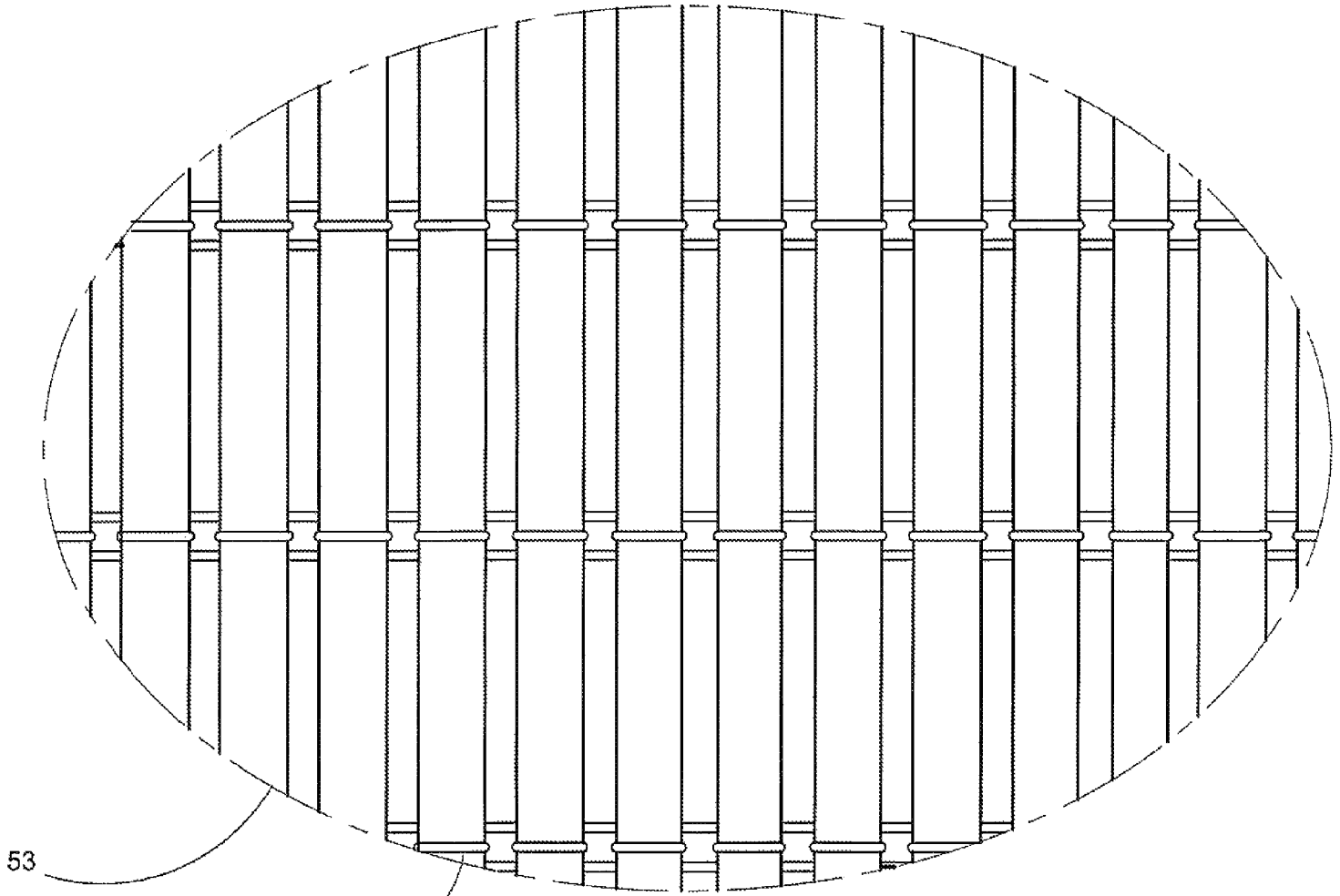
FIG. 3*a* is a detailed view of the mini slats of the folding door.
Figure 3B:
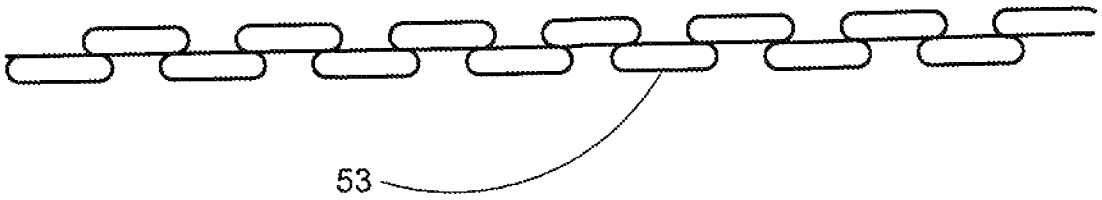
FIG. 3*b* is a top view of the mini slats of the folding door panel showing an overlap in the mini slats.
Figure 3C:
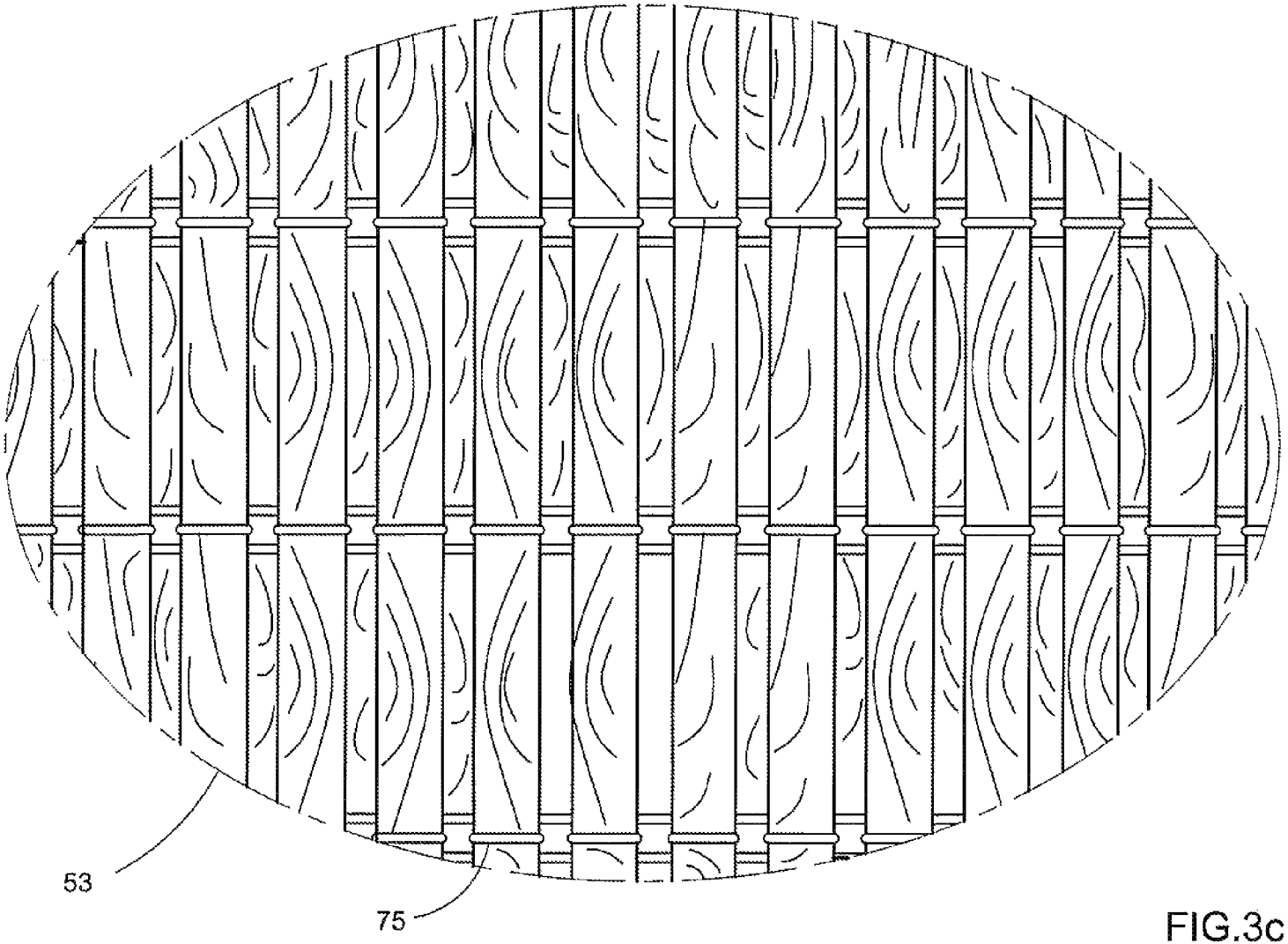
FIG. 3*c* is a wood grain variation embodiment of the folding door panel.

FIG. 3*a* is a detailed view of the mini slats 53 in the folding door panel 21. FIG. 3*b* is a top view of the mini slats in the folding door panel showing an overlap in the mini slats. As shown in FIG. 3*b*, the mini slats 53 overlap each other to form a highly flexible folding door panel 21. The mini slats 53 are secured together with ties 75 formed by horizontal threading. The ties 75 run horizontal to tie up the vertically positioned slats 53. The ties 75 may be plastic, fabric, thread, wire or any suitable material that would serve to securely tie the mini-slats together. FIG. 3*c* is a wood grain variation embodiment of the folding door panel. As shown in FIG. 3*c*, the mini slats 53 may be wood or another material that has been surface treated to look like wood.

Figure 4:
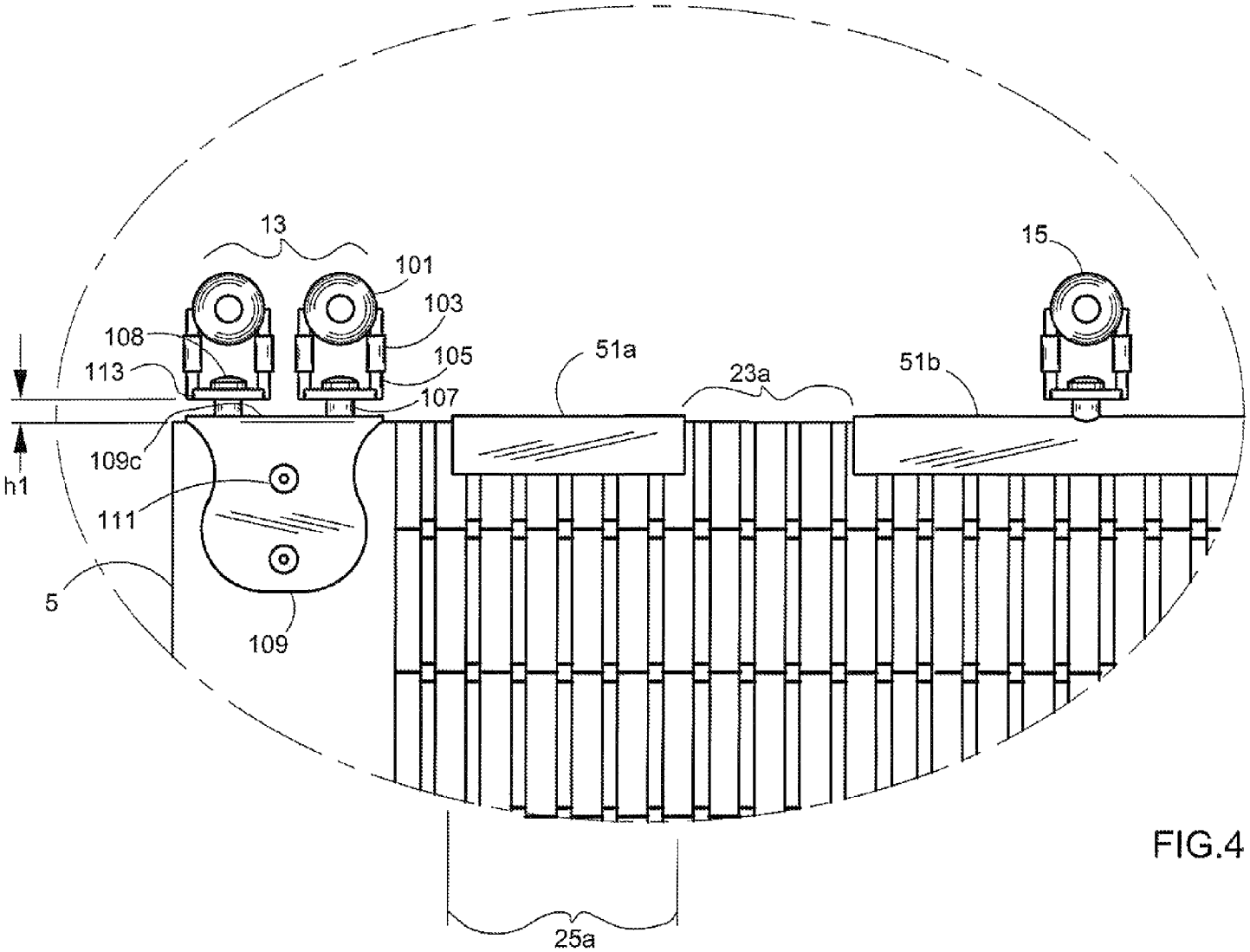
FIG. 4 is a detailed view of dual and single caster assemblies operatively coupling the folding door to the door header.

FIG. 4 is detailed view of the dual caster assembly 13 and the single caster assembly 15. As shown, the single caster assembly 15 and the dual caster assembly 13 contain nearly the same parts, the only difference being that the dual caster assembly 13 contains two caster assemblies and is mounted on a dual caster U-shaped base mount clip 109. Other shaped top binders or clips may be used to fix castors on the end frame elements and the bound segments. Additionally, although the caster assemblies 13, 15 are shown with two wheels per caster, the caster assembly of the invention may contain only one low friction wheel 101. The dual caster assembly 113 is mounted on the fore end leading edge door piece 5. The dual caster assembly 13 is used in the leading edge of the folding door 21 because it provides additional strength to the door. The use of the dual caster assembly 13 allows the leading edge of the door to accommodate the forces that are typically put on a door to open and close it. The single caster assembly 15 is mounted on the center of mid top binder 51*b*. Shown between mid top binder 51*a* and the dual caster assembly 13 is forward top binder 51*a*. As used herein, the term "top binder" or "clip" shall apply to all members that serve to bind the mini slats together or to attach the casters to the folding door.

Figure 5:
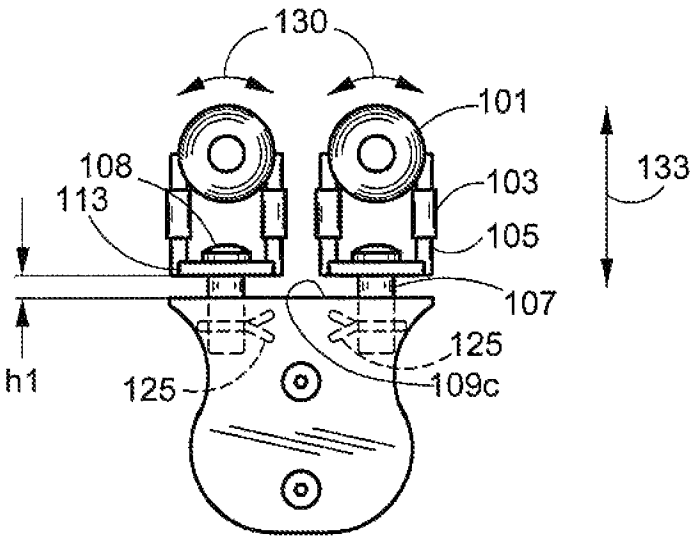
FIG. 5 is a detailed front view of a dual caster assembly.

As shown in FIG. 4 and in further detail in FIG. 5, the caster assemblies 13, 15 are composed of one or more low friction wheels 101 mounted on a U-shaped frame 155 having two depending legs 105. The low friction wheels 101 can be made of a variety of materials, such as plastic, nylon, polymers, phenolics, acetal, polytetrafluoroethylene, or like materials. Surrounding the middle of each leg 105 are low friction sleeves 103. The sleeves 103 make the folding door panel 21 quiet, as well as smooth to roll, as the caster assembly 13, 15 moves through the hanging track channel 9.

Although cylindrical sleeves are shown, half pipe sleeves may be used to provide a low friction barrier between legs 105 and the vertical edge (defining the opening in the channel track) of the channel track.

The distal downward portion of each leg 105 is attached perpendicularly to a ring 113. A movable stem 107 sits in the ring 113 with a stem cap 108 that overhangs atop the ring 113. The caster assemblies 13, 15 provide a smooth sliding folding door panel 21 by absorbing forces put on the door through: (1) the pitch, yaw and roll created by the movement in all directions of the stem 107 within the ring 113, (2) the rotation allowed by the stem 107 in the ring 113 and (3) the use of low friction material on the sleeves 103 and the wheels 101. In this manner, the bound door segments move in a swivel manner, that is, a swivel connection, with respect to the caster, which moves longitudinally in the header channel track. Vertical movement is permitted between the ring and cap. 360 degree movement is permitted by a small diameter stem in a larger aperture in the ring. The pitch, yaw and roll allows the caster assemblies 13, 15 to move all the way around thus increasing the flexibility and stability of the folding door system 1. As used herein, pitch, yaw and roll shall have their customary meanings, namely, pitch is understood to mean the rotation around the side to side axis, yaw is understood to mean the rotation around the vertical axis, and roll is understood to mean the rotation around the front to back axis. The distance between the ring 113 and the upward leg of dual caster U-shaped base mount clip 109*c* is designated as h1. Distance h1 is a variable distance that fluctuates due to the yaw, pitch and roll of the stem 107 seated in the ring 113.

In an alternate embodiment, the caster assembly 13, 15 may use one or more low friction wheels 101 adapted to move in the hanging channel track 9. A depending stem 107 extends downward below the wheel(s) 101. The depending stem 107 forms a low friction interface with the adjacent depending hanging channel track edge 9. The depending stem 107 has a terminal lower end stop. Each top binder 51*b* has an aperture on its upper surface. The depending stem 107 extends through the top binder 51*b* aperture such that the lower stop is below the upper surface of the top binder 51*b* to capture the stem 107 and the caster assembly atop the top binder 51*b*. The stem 107 permits three dimensional movement of the vertical plane segments or door panels with respect to the hanging channel track 9. Additionally, the alternate embodiment may also include caster assembly wheel(s) 101 that rotate about an axis that runs through a hub 155. The hub 155 has depending legs 105 which define a ring 113. The hub legs 105 define an upper stem element 107 carrying the low friction interface. A lower stem 107 element has an upper stop 108 disposed at the lower terminal end of the lower stem 107 below the upper surface of the top binder 51*b*. The lower caster stem element 107 extends through the ring 113 and through the top binder aperture such that the upper stop 108 is above the ring 113 and the lower stop 125 is below the upper surface thereby permitting vertical movement of the caster assembly ring with respect to the top binder 51*b*. The swivel movement of the bound door segments with respect to the caster is accomplished by this simplified stem construct.

FIG. 5 is a detailed front view of the dual caster assembly with the dual caster U-shaped base mount clip 109 cut away to reveal a retaining pin 125 securing the stem 107 within the ring 113 and thereby attaching the dual caster assembly 13 to the dual caster U-shaped base mount clip 109 of the folding door panel 21. A retaining pin 125 is also used to attach a single caster assembly 15 to a mid clip 51 b on the mid bound panel segments 25*b*. The retaining pin 125 can be a cotter pin, clip, rivet, bolt, screw or any suitable device to secure the stem 107 within the ring 113 and in the top binder 109, 51*b*. The wheels 101 rotate or spin in both directions as indicated by arrows 130. There is also vertical movement of the caster assembly 13 as indicated by arrow 133.

Figure 6A:
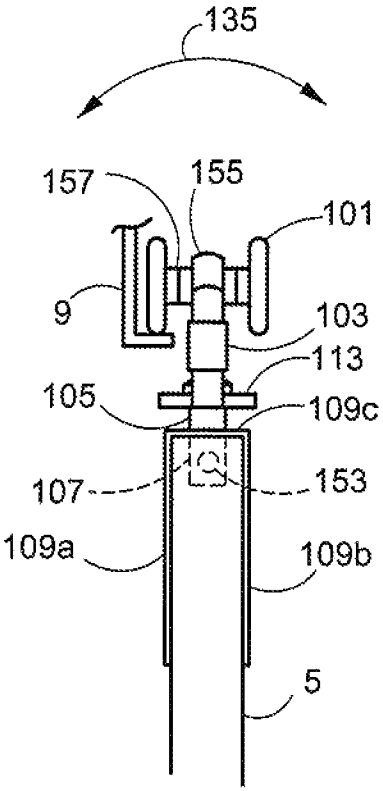
FIG. 6*a* is a detailed side view of a dual caster assembly.

FIG. 6*a* is a detailed side view of the dual caster assembly 13 cut away to show the placement of the stem 107. This view shows the low friction wheels 101 attached to a fixed axel 157. Alternatively, the wheels could rotate on a fixed axle mounted horizontally in frame 155. U-shaped frame 155 has two depending legs 105. The low friction sleeve 103 surrounds the depending leg 105. The stem 107 is seated in the ring 113. The stem 107 proceeds through the upward leg of dual caster U-shaped base mount clip 109*c*. The front side of the dual caster U-shaped base mount clip 109*a* faces to the front of the folding door panel 21 and the rear side of the dual caster U-shaped base mount clip 109*b* faces to the rear of the folding door panel 21. The stem 107 contains a lateral pin hole 153 for receiving a pin, rivet, or any device capable of securing the stem 107 within the ring 113 and onto the fore end leading edge door piece 5. Three dimensional movement of the caster assembly 13 in the hanging channel track 9 is shown by arrow 135.

Figure 6C:
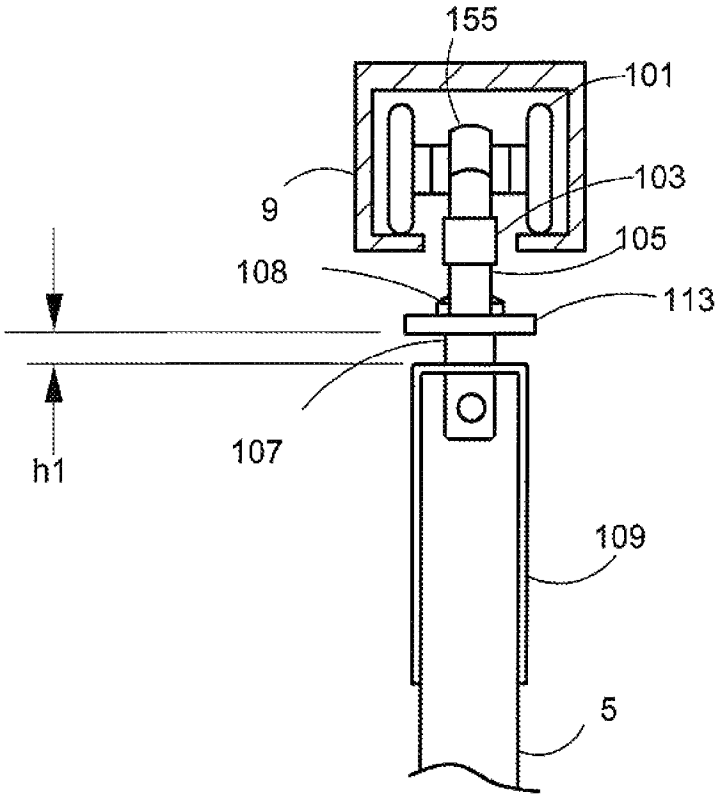
FIG. 6*c* is a cut away view of the caster assembly seated in the hanging channel track showing the cap and stem behind the leg.
Figure 6B:
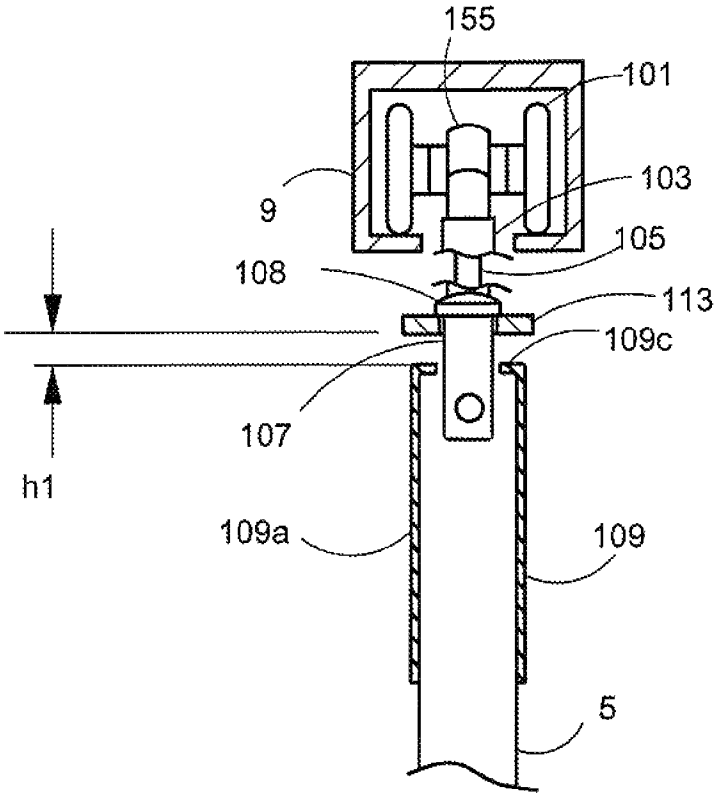
FIG. 6*b* is a cut away view of the caster assembly seated in the hanging channel track (the track attached to the heard) and showing the leg and ring cut away to reveal the position of the stem and the cap.

FIGS. 6*b* and 6*c* both show a caster assembly 13 seated in the hanging channel track 9. FIG. 6*b* is a cut away view of the caster assembly 13 seated in the hanging channel track 9 also showing the depending leg 105 and ring 113 cut away to reveal the position of the stem 107 and cap 108. The low friction wheels 101 are seated in the hanging channel track 9. The depending leg 105 extends down from the U-shaped frame 155. Surrounding the depending leg 105 is a sleeve 103 composed of low friction material. The sleeve 103 engages the edges of the hanging track channel and reduces friction that is caused by the caster assemblies being slid back and forth in the hanging track channel 9 as the door is opened and closed. This reduces the noise of the caster assembly 13, 15 and creates a smooth glide in the hanging channel track 9. The depending leg 105 and ring 113 is cut away to show the position of the cap 108 and stem 107 set within the ring 113. Distance h1 is the amount of pitch or vertical movement that is allowed by the stem 107 between the ring 113 and the upward leg of the dual caster U-shaped base mount clip 109*c*. FIG. 6*c* is cut away view of the caster assembly 13 seated in the hanging channel track 9, but the leg 105 and ring 113 are not cut away thus showing the normal view of the cap 108 and stem 107 behind the leg 105.

Figure 6D:
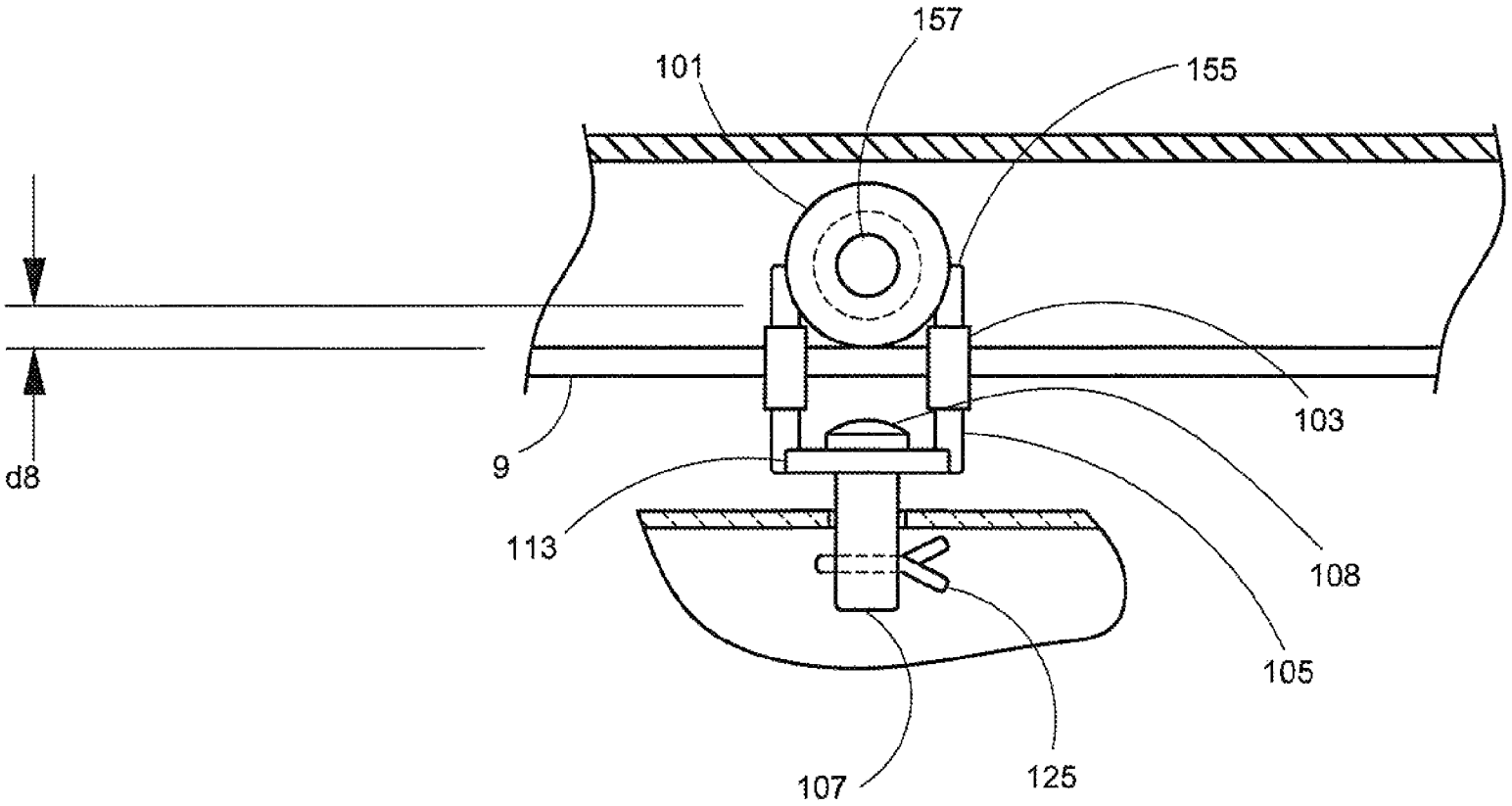
FIG. 6*d* is a cut away front view of caster assembly seated in hanging channel track the near side wheel being but away to reveal the low friction sleeves on the depending legs of U-shaped member.

FIG. 6*d* is a cut away front view of caster assembly 13, 15 seated in the hanging channel track 9, the near side wheel 101 being cut away to reveal the low friction sleeves 103 on the depending legs 105 of the U-shaped member 155. The low friction wheel 101 is shown seated in the hanging channel track 9 with the legs 105 surrounded by sleeves 103. The low friction wheel 101 is cut away to reveal the second low friction wheel 101 sitting behind the first wheel in the hanging channel track 9. Also shown by the low friction wheel 101 being cut away is the U-shaped frame 155 that connects the two depending legs 105 and the fixed axel 157 to which the wheels are attached. Distance d8 is a variable length of distance of the low friction wheel 101 above the hanging channel track 9. The legs 105 attach to the ring 113 through which sits stem 107. The cap 108 of the stem 107 retains the stem 107 in the ring 113 as does pin 125, which secures the bottom of the stem 107 in the ring 113. The use of the cap 108 and pin 125 cause there to be a significant amount of pitch, yaw and roll within the caster assembly 13, 15.

Figure 7:
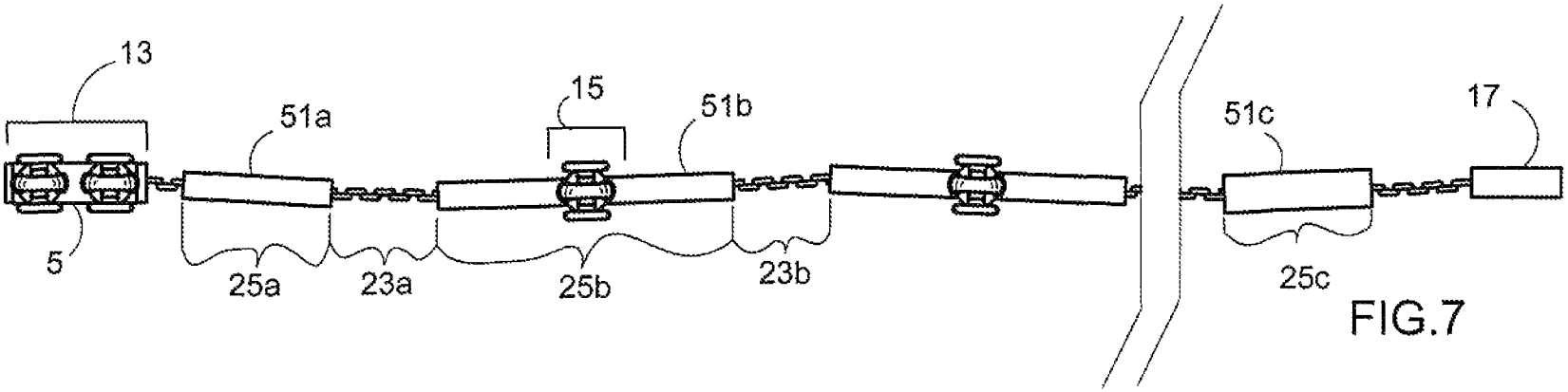
FIG. 7 is a top view of the folding door.
Figure 8:
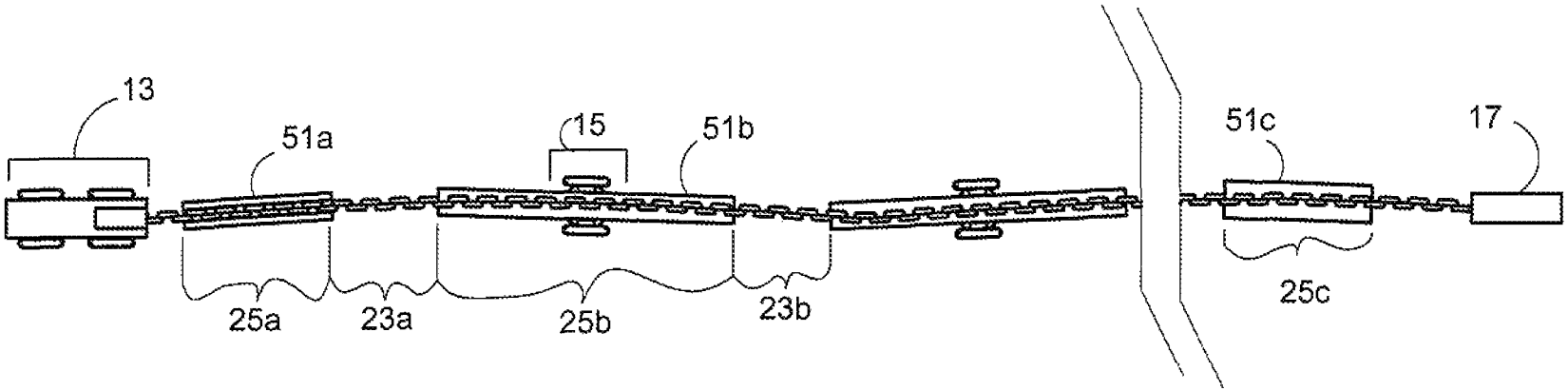
FIG. 8 is a bottom view of the folding door.

FIG. 7 is a top view of the folding door system 1 and FIG. 8 is a bottom view of the folding door system 1. Both of these views show the folding door panels 21 in the closed or extended position. The dual caster assembly 13 is attached onto the fore end leading edge door piece 5 followed by a number of unbound mini slats 53 that are adjacent the forward top binder 51*a*. Forward top binder 51 a holds together the mini slats of forward bound panel segment 25*a*. There is no caster assembly on the forward top binder 51*a*. Following forward top binder 51*a* is forward folding panel seam segment 23*a* and then mid top binder 51*b*. Mid top binder 51*b* holds together the mini slats of the mid bound panel segments 25*b*. There is a single caster assembly 15 attached to the mid top binder 51*b*. Following mid top binder 51*b* is mid folding panel segment 23*b*. As shown, the number of mid top binder 51*b* or mid bound panel segments 25*b* and mid folding panel segments 23*b* are determined by the desired length of the folding door panel 21. Following the required number of mid bound panel segments 25*b* and mid folding panel segments 23*b*, is rear top binder 51*c*. Rear top binder 51*c* holds together the mini slats of the rear bound panel segment 25*c*. There is no caster assembly on rear top binder 51*c*. The rear bound panel segment 25*c* is followed by a number of unbound mini slats that are adjacent the rear edge door piece 17.

Figure 9:
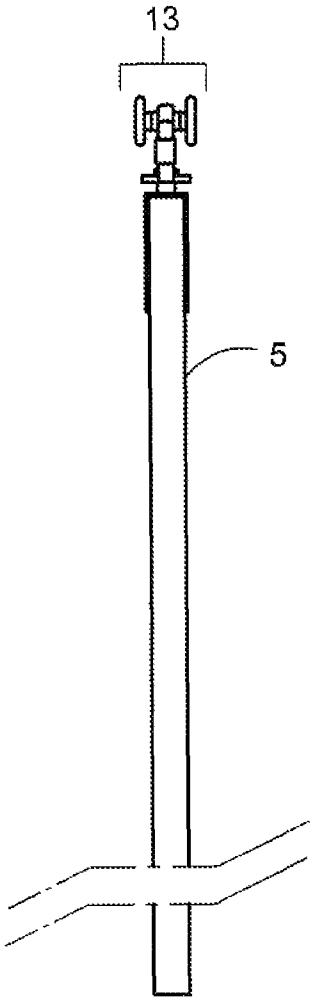
FIG. 9 is a side view of the fore end of the folding door.

FIG. 9 is a side view of the fore end of the folding door panels 21. The dual caster assembly 13 is shown attached to the top of the fore end leading edge piece 5.

Figure 10:
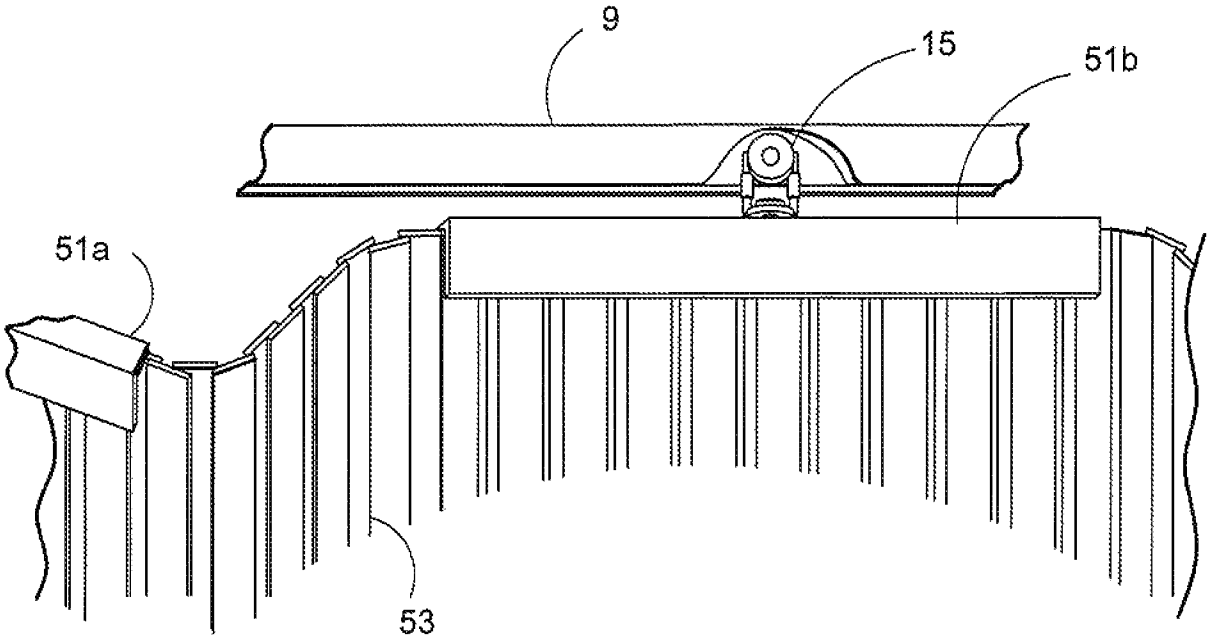
FIG. 10 is a partial elevational view showing the folding door partially open.

FIG. 10 is a partial elevational view showing the folding door system 1 partially open. In this view, a single caster assembly 15 is shown seated in the hanging channel track 9. The single caster assembly 15 is attached to mid top binder 51*b*. Preceding mid top binder 51*a* is forward top binder 51*a* to which no caster assembly is attached.

Figure 11:
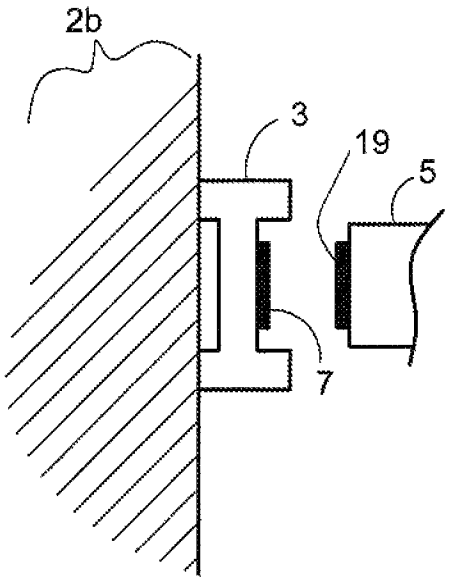
FIG. 11 is a top view of the magnetic closing mechanism of the folding door.

The closing mechanism of the folding door system 1 is shown in FIG. 11. The forward jamb edge piece 3 is attached to the forward door jamb 26. Seated on the outward edge of the forward jamb edge piece 3 are magnetic plates 7. Attached onto the fore end leading edge door piece 5 are magnetic buttons 19. As the folding door closes, the forward jamb edge piece 3 receives the fore end leading edge piece 5 and secures the folding door in a closed position through the contact of the magnetic buttons 19 with the magnetic plates 7. A tongue and groove mount is created with the magnets holding together the forward jamb piece 3 and the fore end leading edge piece 5.

Figure 12:
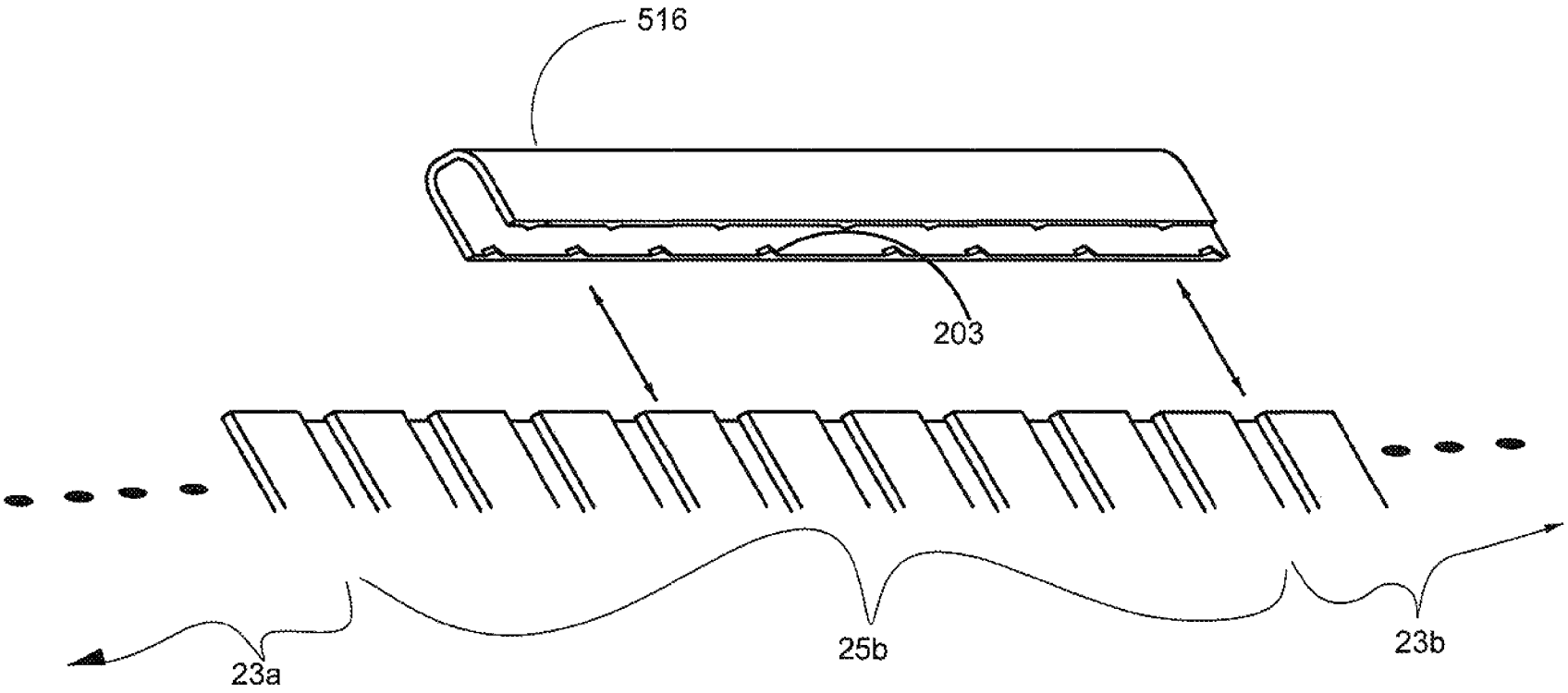
FIG. 12 is an exploded view of a clip attachable to the top of the folding door panel, which clip forms a bound panel segment. Multiple clips form multiple spaced apart bound panel segments that fold adjacent each other in a door closed mode.

FIG. 12 is an exploded view of a top binder 51*b* attachable to the top of the folding door panel 21, which top binders form a bound panel segment 25*b*. The mid top binder 51*b* contains serrated teeth 203 that serve to grip the mini slats 53 and hold the mid top binder 51*b* in place. The mid top binder 51*b* holds a segment of mini slats 53 together to form mid bound panel segments 25*b*. Forward folding panel seam segment 23*a* proceeds mid bound panel segment 25*b* and mid folding panel seam segment 23*b* follows mid bound panel segment 25*b*. Accordingly, there is a folding panel seam segment 23*a*, 23*b* surrounding each mid bound panel segment 25*b*.

In an alternate embodiment, there are double folding door panels 21 that close in the middle of the door way. A double folding door would likely be designed for larger than normal door ways.

Although described above in connection with a specific embodiment, this is not meant to be limiting, as other folding door systems can be made in accordance with the description herein. As such, although the invention is illustrated and described herein, various modifications and structural changes may be made therein without departing from the spirit of the invention and within the scope and range of equivalents of the claims.

The invention claimed is:

1. A folding door adapted to be attached to a door jamb having a forward door jamb, a header, and a rear door jamb comprising:

a plurality of mini slats adapted to be hung vertically from the door header via a hanging channel track attachable to the header, each mini slat being horizontally coupled together such that the plurality of mini slats form a flexible folding door panel, said folding door panel adapted to substantially span and enclose a space between the forward and rear door jamb, said flexible folding door panel having a forward end near the forward door jamb and a rearward end near the rear door jamb;

said folding door panel defining, in series, bounded vertical plane door segments interposed between folding seam door segments;

each bounded vertical plane segment having a first subplurality of mini slats maintained in a substantially single vertical plane by a top binder;

each folding seam segment having a second subpluratity of mini slats which establish the folding panel seam segments of the folding door;

said seam segments being intermediate said plane segments;

the forward end of said folding door panel having a forward edge segment adapted to be adjacent said forward door jamb, said forward edge segment having a door closure element;

a forward jamb edge piece adapted to be fixedly attached to the forward door jamb, said forward jamb edge piece having a complementary closure element adapted to cooperate with said closure element on said forward edge segment permitting said folding door panel to open and close on said forward door jamb;

said folding door panel having a rearward edge piece adapted to be attached to the rear door jamb;

a plurality of caster assemblies movably disposed in said hanging channel track, a respective caster assembly attached to a corresponding top binder;

each caster assembly including:

two or more low friction wheels adapted to move in said hanging channel track, a depending stem extending downward below the wheels, said depending stem forming a low friction interface with the adjacent depending track edge, said depending stem having a terminal lower end stop;

each top binder defining an aperture at its upper surface;

said depending caster stem extending through said top binder aperture such that said lower stop is below said upper surface of said top binder to capture the stem and the caster assembly atop said top binder;

said stem permitting three dimensional movement of said vertical plane segments with respect to said hanging channel track;

wherein each caster assembly includes:

an axis extending between the at least two wheels which wheels rotate about the axis, said axis running through a hub, said hub having depending legs which legs define a ring-like member;

said hub legs defining an upper stem element carrying said low friction interface;

a lower stem element having an upper stop disposed above said ring member, said lower stem stop disposed at the lower terminal end of said lower stem, below said upper surface of said top binder;

the lower caster stem element extending through said ring and through said top binder aperture such that said upper stop is above said ring member and lower stop is below said upper surface thereby permitting vertical movement of the caster assembly with respect to said top binder.

2. The folding door of claim 1 wherein said stem defines a swivel joint between said caster assembly and said top binder, said swivel joint permitting said three dimensional movement of said respective vertical plane segment and said hanging channel track.

3. The folding door of claim 2 wherein said hub defines a U-shaped caster base with depending legs, each depending leg forming low friction interfaces with said depending track edge.

4. The folding door of claim 1 wherein said stem defines a swivel joint between said caster assembly and said top binder, said swivel joint permitting said three dimensional movement of said respective vertical plane segment and said hanging channel track.

5. The folding door of claim 1 wherein the wheels of each caster assembly are adapted to be seated in the hanging channel track allowing the folding door panel to slide open and closed, said closure element adapted to join with said complementary closure element and close the folding door panel close on said forward door jamb.

6. A folding door adapted to be attached to a door jamb having a forward door jamb, a header, and a rear door jamb comprising:

a plurality of mini slats adapted to be hung vertically from the door header, each mini slat being horizontally coupled to her to form a flexible folding door panel, which is adopted to substantially span and enclose the space between the forward and rear door jamb, said flexible folding door panel having a forward end near the forward door jamb and a rearward end near the rear door jamb;

a subplurality of mini slats which are substantially maintained in a single plane bounded on upper edge regions of said subplurality of mini slats by a top binder to establish a non folding, bound panel segment of the folding door;

a second subplurality of mini slats which establish the folding panel seam segments of the folding door;

wherein the folding panel seam segments are intermediate forward and rearward of bound panel segments of the folding door;

a forward jamb edge piece attachable to the forward door jamb;

a hanging channel track attachable to the header;

a rear edge piece attachable to the rear door jamb and attached to the rearward end of the folding door panel;

a fore end leading edge piece secured to the forward end of the folding door panel;

a dual caster assembly attached to the top of the fore end leading edge piece by a top binder;

a plurality of single caster assemblies, wherein a single caster assembly is attached to the top binder of the bound panel segment of the folding door;

wherein each caster assembly consists of at least two low friction wheels mounted on a U shaped frame having depending legs, each depending leg having a low friction sleeve, the distal portion of each leg is attached perpendicularly to a ring;

wherein a stem is adapted to be seated through the ring and through an aperture in the top binder, the top of the stem has a cap that overhangs the ring, a retaining pin secures the stem within the ring and thereby attaches the assembly to the top binder and the folding door; and wherein the wheels of each caster assembly are adapted to be seated in the hanging channel track allowing the folding door to slide open and closed.

7. The folding door of claim 6, wherein the top binder used to attach dual caster assembly to the top of the fore end leading edge piece is a dual caster U shaped base mount clip.

8. The folding door of claim 6, further including one or more magnetic plates within the forward jamb edge piece; one or more magnetic buttons on the fore end leading edge piece; wherein the forward jamb edge piece receives the fore end leading edge piece and secures the folding door in a closed position through the contact of the magnetic buttons with the magnetic plates.

9. The folding door of claim 6, wherein each caster assembly provides a smooth sliding folding door by absorbing forces put on the door through the pitch, yaw and roll created by the movement in all directions of the stem within the ring and by the rotation of the stem in the ring.

10. The folding door of claim 6, wherein the bound panel segments of the folding door stack against each other when the folding door is slid open due to a folding of the folding panel seam segments from 0 to about 180 degrees.

11. The folding door of claim 6, wherein the single caster assembly is attached to the center of the top binder the bound panel segment of the folding door.

12. The folding door of claim 6, wherein the low friction wheels and low friction sleeves are composed of plastic.

13. A folding door adapted to be attach to a door jamb having a forward door jamb, a header, and a rear door jamb comprising:

a plurality of mini slats adapted to be hung vertically from the door header, each mini slat being horizontally coupled together to form a flexible folding door panel, which is adapted to substantially span and enclose the space between the forward and the rear door jamb, said flexible folding door panel having a forward end near the forward door jamb and a rearward end near the rear door jamb;

a subpluratity of mini slats which are substantially maintained in a single plane bounded on upper edge regions of said subplurality of mini slats by a top binder to establish a non folding, bound panel segment of the folding door;

a second subplurality of mini slats which establish the folding panel seam segments of the folding door;

wherein the folding panel seam segments are intermediate forward and rearward of bound panel segments of the folding door;

a dual caster assembly attached to the top of a fore end leading edge piece, said fore end leading edge piece secured to the forward end of the folding door panel by a dual caster U shaped mount clip;

a plurality of single caster assemblies, wherein a single caster assembly is attached to the top binder of the bound panel segment of the folding door;

each caster assembly consists of at least two low friction wheel mounted on a U shaped frame having depending legs, each depending leg having a low friction sleeve, the distal portion of each leg is attached perpendicularly to a ring; and wherein a stem is adapted to be seated through the ring and through an aperture in the top binder, the top of the stem has a cap that overhangs the ring, a retaining pin secures the stem within the ring and thereby attaches the assembly to the top binder and the folding door.

14. The folding door of claim 13, further including a forward jamb edge piece attachable to the forward door jamb; a hanging channel track attachable to the header; and a rear edge piece attachable to the rear door jamb and secured to the rearward end of the folding door panel.

15. The folding door of claim 13, wherein each caster assembly is adapted to be seated in the hanging channel track allowing the folding door to slide open and closed.

16. The folding door of claim 13, wherein each caster assembly provides pitch, yaw and roll that allows the stem to move in all directions within the ring.

17. The folding door of claim 14, further including one or more magnetic plates within the forward jamb edge piece; one or more magnetic buttons on a fore end leading edge piece; wherein the forward jamb piece receives the fore end leading edge piece and secures the folding door in a closed position through the contact of the magnetic buttons with the magnetic plates.

18. The folding door of claim 13, wherein the bound panel segments of the folding door stack against each other when the folding door is slid open due to a folding of the folding panel seam segments from 0 to about 180 degrees.

19. The folding door of claim 13, wherein the single caster assembly is attached to the center of the top binder of the bound panel segment of the folding door.

20. The folding door of claim 13, wherein the low friction wheels and low friction sleeves are composed of plastic.

21. A folding door adapted to be attached to a door jamb having a forward door jamb, a header, and a rear door jamb comprising:

a plurality of mini slats adapted to be hung vertically from the door header, each mini slat being horizontally coupled together to form a flexible folding door panel, which is adapted to substantially span and enclose the space between the forward and rear door jamb, said flexible folding door panel having a forward end near the forward door jamb and a rearward end near the rear door jamb;

a subplurality of mini slats which are substantially maintained in a single plane bounded on upper edge regions of said subplurality of mini slats by a top binder to establish a non folding, bound panel segment of the folding door;

a second subplurality of mini slats which establish the folding panel seam segments of the folding door;

wherein the folding panel seam segments are intermediate forward and rearward of bound panel segments of the folding door;

a forward jamb edge piece attachable to the forward door jamb;

a hanging channel track attachable to the header;

a rear edge piece attachable to the rear door jamb and attached to the rearward end of the folding door panel;

a fore end leading edge piece secured to the forward end of the folding door panel;

a dual caster assembly attached to the top of the fore end leading edge piece by a dual caster U shaped mount clip;

a plurality of single caster assemblies, wherein a single caster assembly is attached to the top binder of the bound panel segment of the folding door;

wherein each caster assembly consists of at least two low friction wheels mounted on a U shaped frame having depending legs, each depending leg having a low friction sleeve, the distal portion of each leg is attached perpendicularly to a ring;

wherein a stem is adapted to be seated through the ring and through an aperture in the top binder, the top of the stem has a cap that overhangs the ring, a retaining pin secures the stem within the ring and thereby attaches the assembly to the top binder and the folding door;

wherein the wheels of each caster assembly are adapted to be seated in the hanging channel track allowing the folding door to slide open and closed;

wherein each caster assembly provides a smooth sliding folding door by absorbing forces put on the door through the pitch, yaw and roll created by the movement in all directions of the stem within the ring and by the rotation of the stem in the ring;

wherein the bound panel segments of the folding door stack against each other when the folding door is slid open due to a folding of the folding panel seam segments from 0 to about 180 degrees;

one or more magnetic plates within the forward jamb piece;

one or more magnetic buttons on the fore end leading edge piece; and wherein the forward jamb piece receives the fore end leading edge piece and secures the folding door in a closed position through the contact of the magnetic buttons with the magnetic plates.

* * * * *